US012522999B2

(12) United States Patent
Thorsell

(10) Patent No.: US 12,522,999 B2
(45) Date of Patent: Jan. 13, 2026

(54) MULTIPURPOSE BUCKET

(71) Applicant: Great Plains Manufacturing, Inc., Salina, KS (US)

(72) Inventor: Erik Thorsell, Olathe, KS (US)

(73) Assignee: Great Plains Manufacturing, Inc., Salina, KS (US)

( * ) Notice: Subject to any disclaimer, the term of this patent is extended or adjusted under 35 U.S.C. 154(b) by 757 days.

(21) Appl. No.: 17/479,758

(22) Filed: Sep. 20, 2021

(65) Prior Publication Data

US 2022/0090347 A1 Mar. 24, 2022

Related U.S. Application Data

(60) Provisional application No. 63/080,065, filed on Sep. 18, 2020.

(51) Int. Cl.
*E02F 3/413* (2006.01)
*E02F 3/40* (2006.01)
*E02F 3/407* (2006.01)

(52) U.S. Cl.
CPC ..... *E02F 3/413* (2013.01); *E02F 3/404* (2013.01); *E02F 3/4075* (2013.01); *E02F 3/40* (2013.01)

(58) Field of Classification Search
CPC . E02F 3/40; E02F 3/404; E02F 3/4075; E02F 3/413; E02F 3/4133; E02F 3/769
USPC ..... 37/406, 409
See application file for complete search history.

(56) References Cited

U.S. PATENT DOCUMENTS 2,812,595 A * 11/1957 Houghton ..... E02F 3/4133 414/733
2,864,518 A * 12/1958 Beyerstedt ..... E02F 3/407 414/704
3,767,070 A * 10/1973 Arnold ..... E02F 3/962 37/406
4,566,844 A * 1/1986 Campin ..... E02F 3/404 37/409
4,859,130 A * 8/1989 Langenfeld ..... A01D 87/0061 414/722
4,928,410 A * 5/1990 Walters ..... E02F 3/4075 37/409
4,974,350 A * 12/1990 Puckett ..... E02F 3/815 172/438
5,114,299 A * 5/1992 Roche ..... E02F 3/404 414/722
5,165,191 A * 11/1992 Davis ..... E02F 3/7613 37/409
5,940,996 A 8/1999 Cummings
(Continued)

OTHER PUBLICATIONS https://www.deere.com/en/search/?term=Frontier+AV20f; John Deere AF20F, 2 pages.

*Primary Examiner* — Christopher J Sebesta
*Assistant Examiner* — Audrey L Lusk
(74) *Attorney, Agent, or Firm* — Hovey Williams LLP; Kameron D. Kelly

(57) ABSTRACT

A multipurpose bucket comprising a front section and a rear section rotatably coupled with the front section. As such, the bucket is configured to transition from a closed position to an open position. The bucket further comprises a single actuator configured to transition the bucket between the closed position and the open position. The actuator is centrally positioned with respect to a width of the bucket.

16 Claims, 11 Drawing Sheets

(56) References Cited

U.S. PATENT DOCUMENTS

| | | | | |
|---|---|---|---|---|
| 7,913,431 | B1 * | 3/2011 | Beam | A01G 23/06 37/406 |
| 8,631,596 | B2 * | 1/2014 | Tulibaski | E02F 3/962 37/444 |
| 2005/0095109 | A1 * | 5/2005 | Harris | E02F 3/40 414/722 |

* cited by examiner

MULTIPURPOSE BUCKET

CROSS-REFERENCE TO RELATED APPLICATION

The present non-provisional patent application claims priority benefit to U.S. Provisional Patent Application Ser. No. 63/080,065, filed Sep. 18, 2020, and entitled "MULTI-PURPOSE BUCKET." The entirety of the above-identified provisional patent application is hereby incorporated by reference into the present non-provisional patent application.

FIELD OF THE INVENTION

The present invention is related to the field of attachments for heavy-equipment machines. More specifically, the present invention is related to multipurpose buckets that can be used by heavy-equipment machines to pick-up, transport, and deposit material.

DESCRIPTION OF RELATED ART

Heavy-equipment machines commonly used bucket-type attachments to pick up, transport, and deposit material. One type of commonly used bucket is a 4-in-1 bucket, which is sometimes referred to as a "multipurpose bucket." Multipurpose buckets generally comprise front and rear sections that are configured to shift positions relative to one another. As such, multipurpose buckets are capable of operating in various configurations. For example, multipurpose buckets may be selectively operated as (1) a standard bucket for digging, transporting, and dumping material (e.g., soil/dirt), (2) a grapple for picking up and moving material (e.g., logs or debris), (3) a blade for pushing material (e.g., soil/dirt), similar to a dozer blade, and/or (4) a box blade for back dragging material (e.g., soil/dirt).

To allow a multipurpose bucket to be positioned in the various configurations, the front section and the rear section are generally pivotally secured to each other at lateral sides of the bucket. Actuation of the front and rear sections would commonly be accomplished using a pair of hydraulic cylinders positioned on each lateral side of the bucket. Due to the use of multiple cylinders, previously-used multipurpose buckets were quite large and heavy. As such, previously-used multipurpose buckets were commonly only used on large heavy-equipment machines, such as loaders, excavators, and skid steers. However, such previously-used multipurpose buckets were generally not suitable for use on relatively small heavy-equipment machines, such as compact utility loaders.

SUMMARY

To address the above-described challenges encountered with previously-used multipurpose buckets, embodiments of the present invention comprise a multipurpopse bucket comprising a front section and a rear section rotatably coupled with the front section. As such, the bucket is configured to transition from a closed position to an open position. The bucket further comprises a single actuator configured to transition the bucket between the closed position and the open position. The actuator is centrally positioned with respect to a width of the bucket.

Embodiments of the present invention additionally include a multipurpopse bucket comprising a front section and a rear section rotatably coupled with the front section, such that the bucket is configured to transition from a closed position to an open position. The bucket additionally comprises a laterally extending shaft extending across at least a portion of a width of the bucket. The bucket further comprises a single actuator configured to transition the bucket between the closed position and the open position. The actuator is centrally positioned with respect to the width of the bucket. The actuator is configured to actuate the pivot shaft. The actuator is engaged with the shaft at or adjacent a lateral midpoint of the shaft.

Embodiments of the present invention additionally include a method of operating a multipurpopse bucket. The method comprises one or more steps, including providing the bucket which comprises a front section and a rear section rotatably coupled with the front section. As such, the bucket is configured to transition from a closed position to an open position. The bucket additionally comprises a single actuator positioned within a centrally positioned pocket formed in the rear section. An additional step of the method includes shifting, via the single actuator, the bucket from the closed position to the open position. A further step of the method includes shifting, via the single actuator, the bucket from the open position to the closed position.

BRIEF DESCRIPTION OF THE DRAWINGS

Embodiments of the present invention are described in detail below with reference to the attached drawing figures, wherein.

Figure 1:
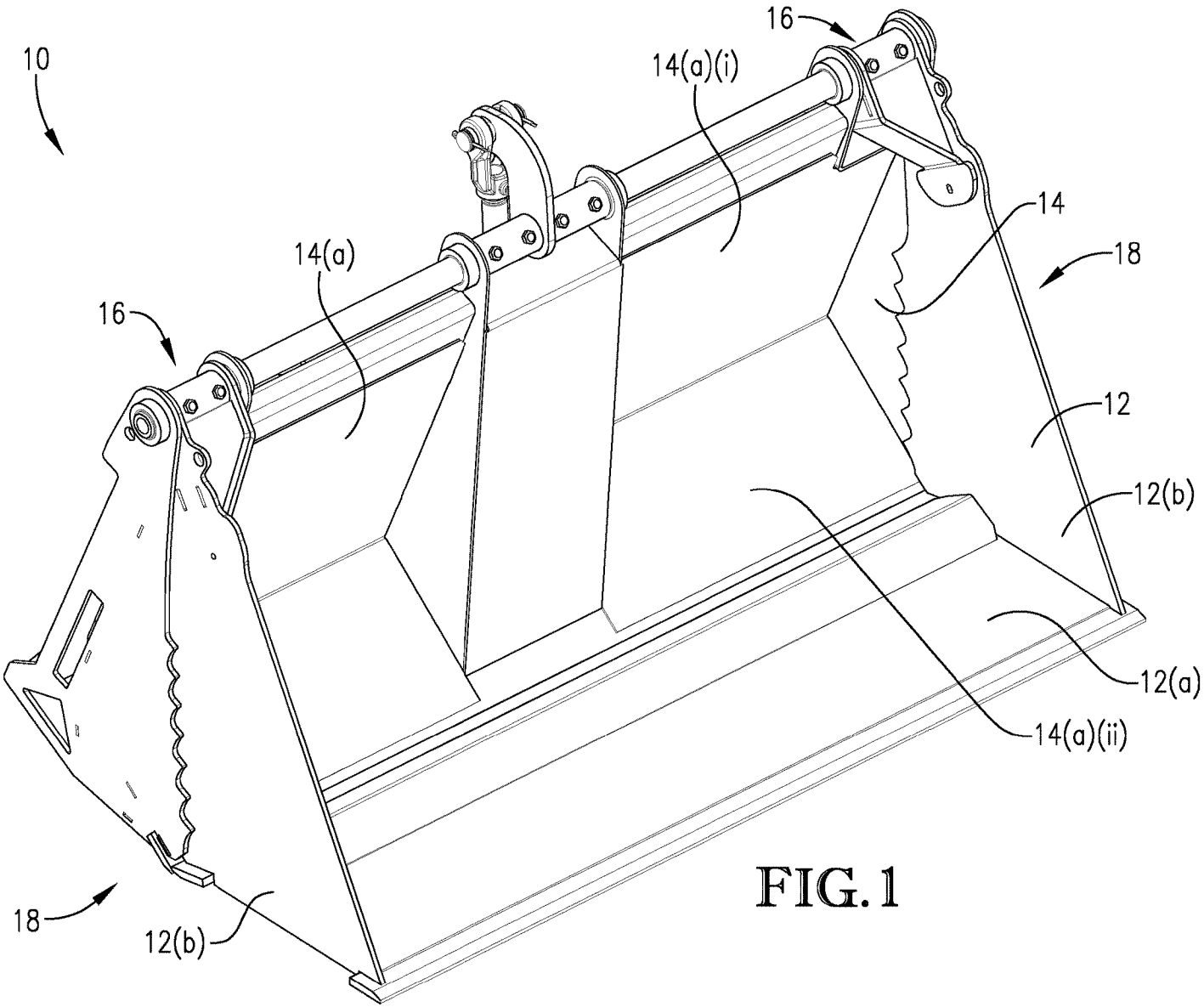
FIG. 1 is a front, side perspective view of a multipurpose bucket according to embodiments of the present invention, with the bucket in a closed position.

The figures are not intended to limit the present invention to the specific embodiments they depict. While the drawings do not necessarily provide exact dimensions or tolerances for the illustrated structures or components, the drawings are to scale with respect to the relationships between the components of the structures illustrated in the drawings.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
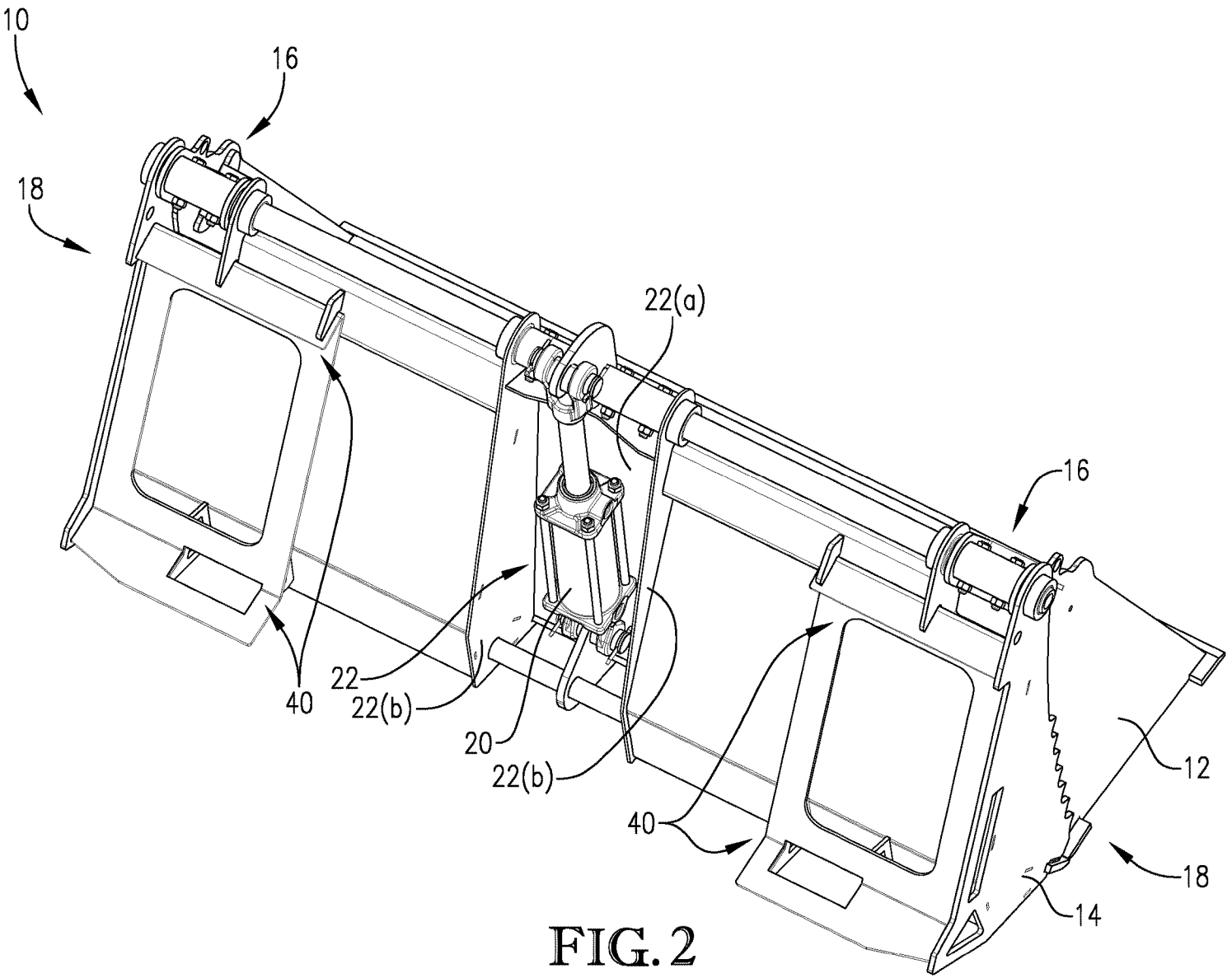
FIG. 2 is a rear, side perspective view of the bucket from FIG. 1.

With reference to the figures, embodiments of the present invention includes a multipurpose bucket 10, such as illustrated in FIGS. 1 and 2. The multipurpose bucket 10 comprises a front section 12 and a rear section 14, with the front and rear sections 12, 14 being rotatably connected to each other via rotation connections 16 located at lateral sides 18 of the bucket 10. In some embodiments, the rotation connections 16 may be located at upper portions of the lateral sides 18 of the bucket 10. In such a configuration, the bucket 10 can transition from a closed position in which the front and rear sections 12, 14 are positioned adjacent to one another (see, e.g., FIGS. 1 and 2), to an open position in which the front and rear sections 12, 14 (or a portion thereof) are rotated away from one another (see, e.g., FIGS. 3 and 4) about the rotation connections 16.

Figure 3:
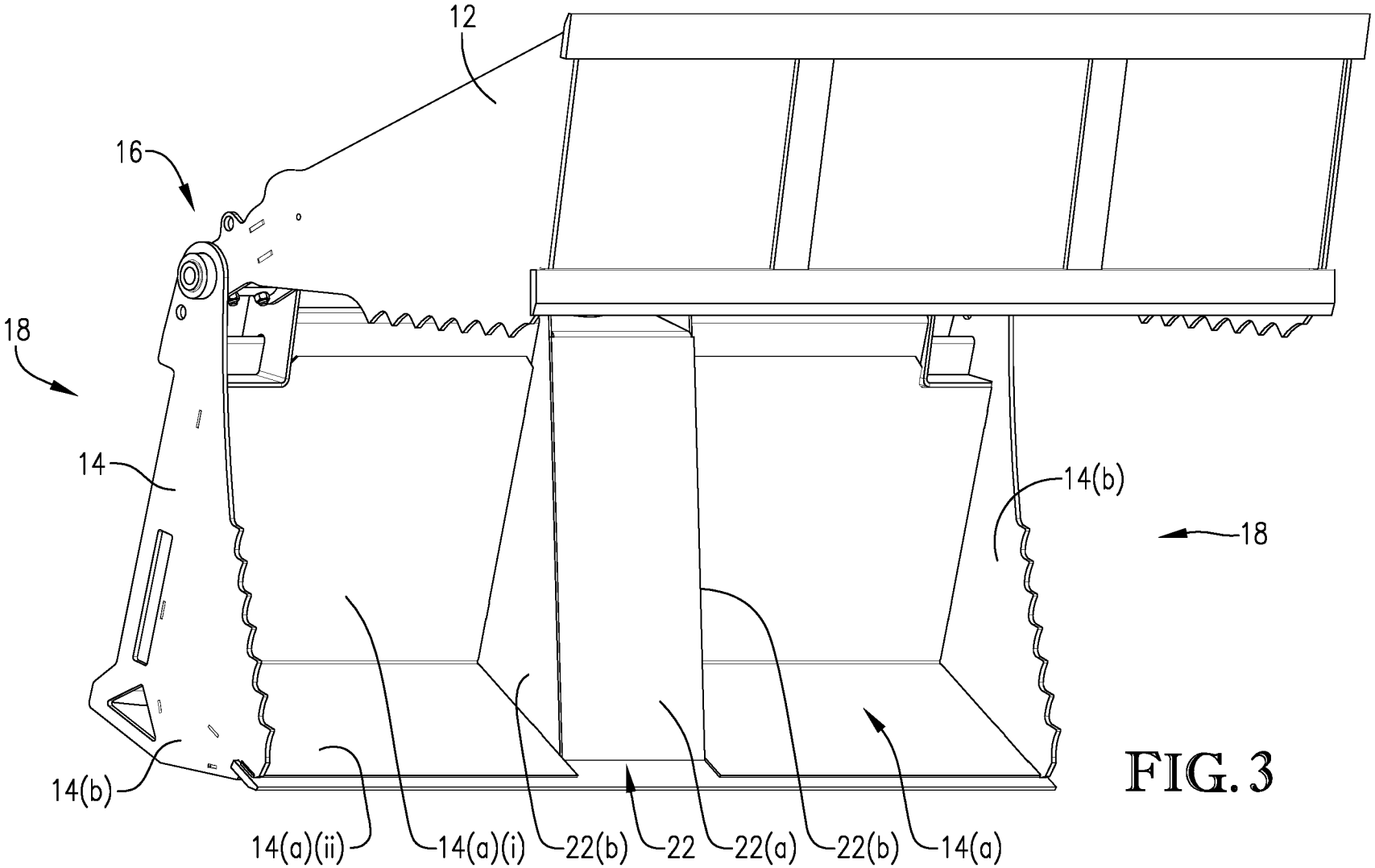
FIG. 3 is a front, side perspective view of the bucket from FIGS. 1 and 2, with the bucket in an open position.

In more detail, the front section 12 of the bucket may generally comprise a bottom panel 12(*a*) and a pair of side panels 12(*b*), as illustrated in FIG. 1 (with the bottom panel 12(*a*) extending between and connecting the side panels 12(*b*)). The side panels 12(*b*) may form part of the lateral sides 18 of the bucket 10. In some embodiments, back edges of the side panels 12(*b*) may comprise rearwardly extending serrated blades. With reference to FIG. 3, the rear section 14 may comprise a main panel 14(*a*) and a pair of side panels 14(*b*) (with the main panel 14(*a*) extending between and connecting the side panels 14(*b*)). The side panels 14(*b*) may form part of the lateral sides 18 of the bucket 10. In some embodiments, front edges of the side panels 14(*b*) may comprise forwardly extending serrated blades. The main panel 14(*a*) may comprises an upper portion 14(*a*)(i) and a lower portion 14(*a*)(ii). In some embodiments, the upper portion 14(*a*)(i) and the lower portion 14(*a*)(ii) are connected with each other in such a manner that the portions are oriented at angles with respect to each other. As such, the rear section 14 is configured to form a concave shape when viewed from a front of the bucket 10, such as may be beneficial for holding material during operation of the bucket 10.

In the closed position, rear edges of the front section 12 will be adjacent to and/or engaged with front edges of the rear section 14 (see, e.g., FIGS. 1 and 2). In contrast, in the open position, the rear edges of the front section 12 will be spaced apart from the front edges of the rear section 14 (see, e.g., FIGS. 3 and 4). In certain embodiments, portions of the rear edges of the front section 12 and the front edges of the rear section 14 may comprise serrated edges or blades. For example, the rear edges of the front section 12 and the front edges of the rear section 14, which comprise the lateral sides 18 of the bucket 10 may be at least partially formed with serrated edges. Such serrated edges may facilitate grasping of items (e.g., wood logs, tree trunks, brush, etc.) when the bucket 10 is used grapple, as will be described in more detail below.

Figure 4:
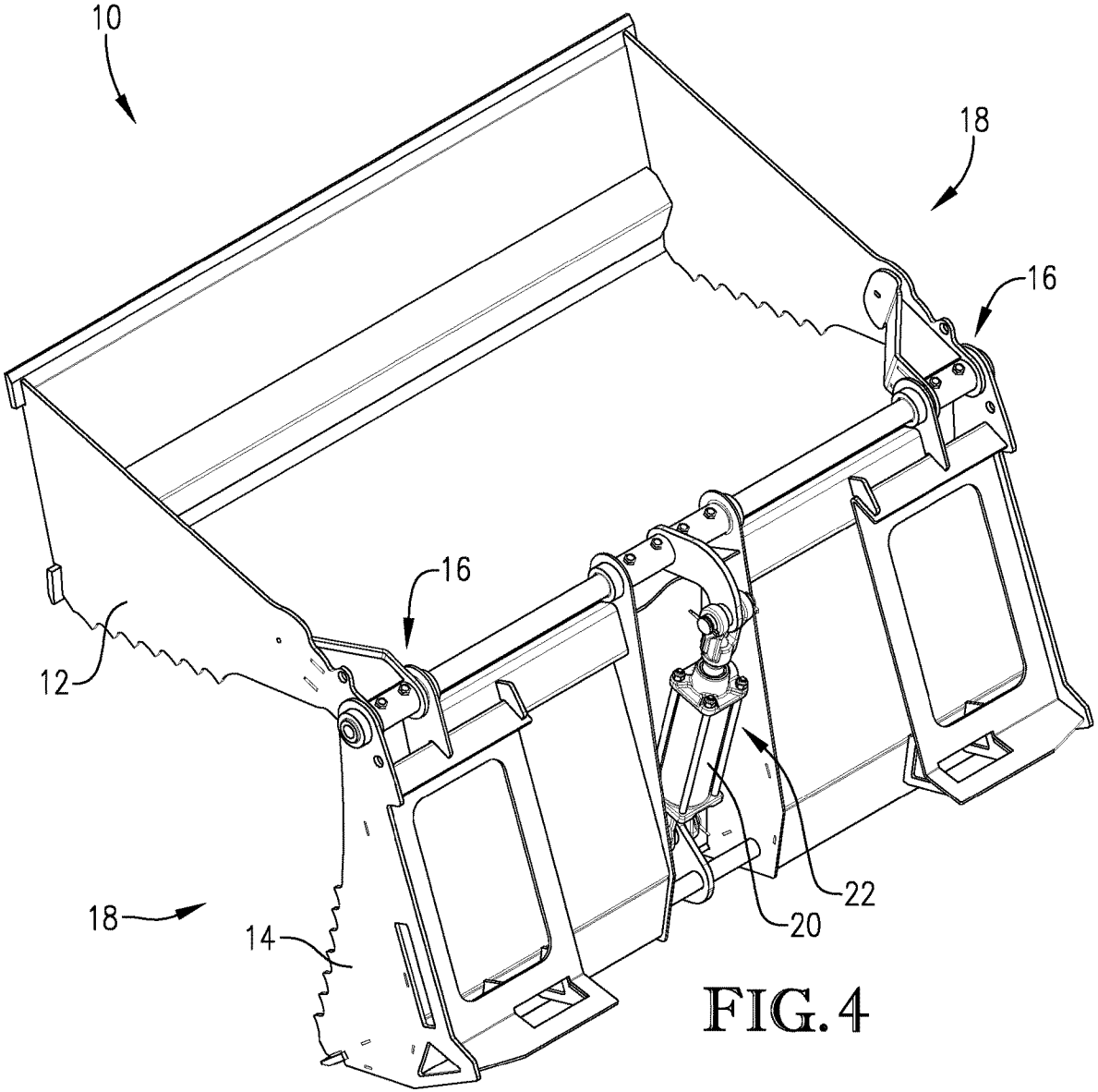
FIG. 4 is a rear, side perspective view of the bucket from FIG. 3.

To transition the bucket 10 between the closed and open positions, the bucket 10 may include only a single actuator 20, as perhaps best illustrated in FIGS. 2 and 4. Stated differently, embodiments of the present invention provide for the bucket 10 to include no more than one actuator 20 that is used to transition the bucket 10 between open and closed positions. In some embodiments, the actuator 20 may comprise a hydraulic cylinder. In other embodiments, the actuator 20 may comprise various other types of actuators, such as pneumatic or electric actuators. In addition, the actuator 20 may be linear or rotary. In some embodiments, the actuator 20 may be centrally positioned with respect to the bucket 10. For example, as illustrated in FIGS. 2 and 4, a rearward-facing exterior side of the rear section 14 may include a pocket 22 in which the actuator 20 is at least partially received.

The pocket 22 may be formed in the main panel 14(*a*) of the rear section 14 of the bucket 10. In some embodiments, the pocket 22 may be part of the main panel 14(*a*) of the rear section 14 of the bucket 10. In more detail, the pocket 22 may comprise a central panel 22(*a*) and a pair of side panels 22(*b*), as illustrated in FIGS. 2 and 3 (with the central panel 22(*a*) extending between and connecting the side panels 22(*b*)). The pocket 22 may extend forward and/or protrude from front surfaces of the upper and lower portions 14(*a*)(i), 14(*a*)(ii) of the main panel 14(*a*), as illustrated in FIG. 1. As such, the pocket 22 may separate the upper and lower portions 14(*a*)(i), 14(*a*)(ii), each into left and right sections that oppose the protruding pocket 22. Correspondingly, due to the forward extension of the pocket 22, the pocket presents a cavity at the back side of the bucket 10, within which the actuator 20 can be positioned. As such, the pocket 22 opens to a rear exterior face of the main panel 14(*a*) of the rear section 14 of the bucket 10.

Figure 5:
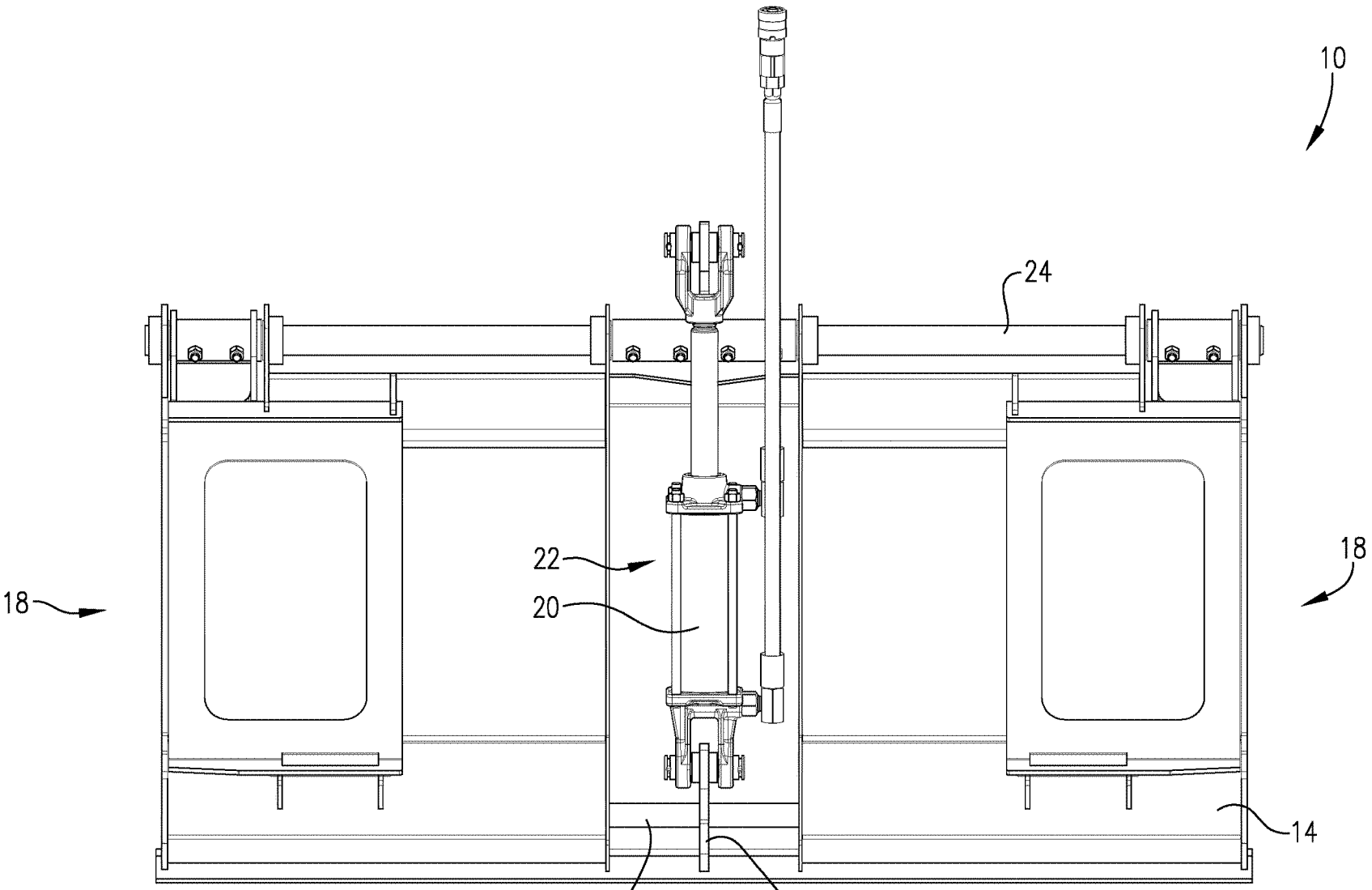
FIG. 5 is a rear elevation view of the bucket from FIGS. 1 and 2.

The pocket 22, as well as the actuator 20, may be positioned centrally with respect to the bucket 10 i.e., generally equidistant from each of the lateral sides 18 of the bucket 10, as perhaps best illustrated in FIG. 5. To secure the actuator 20 in place within the pocket 22, a bottom of the actuator 20 may be pivotably coupled to a bottom side of the rear section 14 of the bucket 10. Specifically, a support bar 30 may extend laterally across the interior of the pocket 22, with a connection bracket 32 rigidly secure to and extending upward from the support bar 30. The bottom of the actuator 20 may be pivotably coupled to the connection bracket 32.

Figure 6:
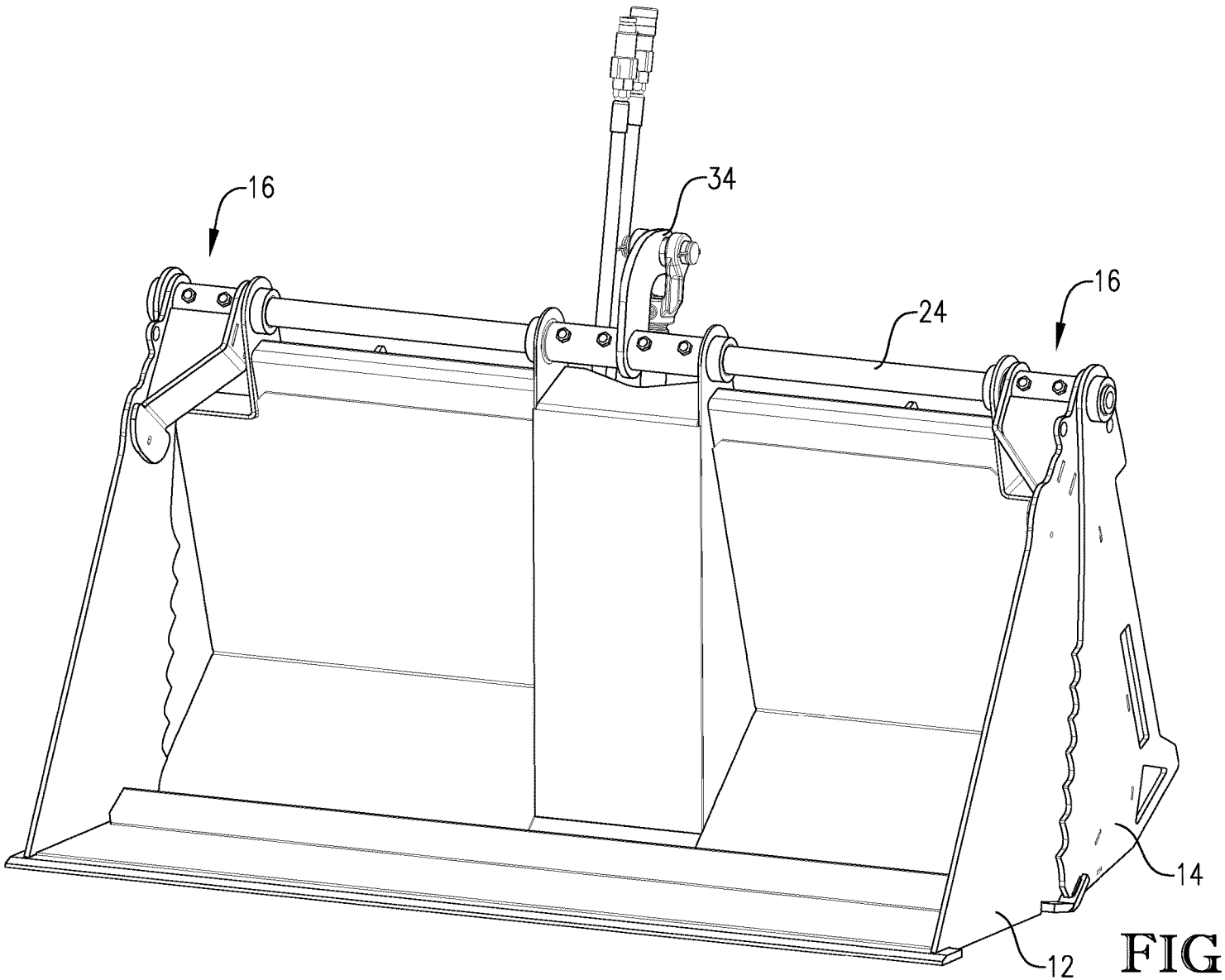
FIG. 6 is another front, side perspective view of the bucket from FIGS. 1 and 2.

The actuator 20 may extend upward from the connection bracket 32, with a top of the actuator 20 being pivotably connected with a pivot shaft 24, as shown in FIG. 5. In particular, as perhaps best shown in FIG. 6, a lever arm 34 may be rigidly connected with and extend upward from (or otherwise away from) the pivot shaft 24 (the lever arm 34 may be engaged with the pivot shaft 24 near a lateral midpoint of the pivot shaft 24), and the top of the actuator 20 may be pivotably coupled with the lever arm 34. As such, the actuator 20 is engaged and/or coupled with the pivot shaft 24 near a lateral midpoint of the pivot shaft 24. In such a configuration, actuation of the actuator 20 will cause rotation of the pivot shaft 24. For example, in embodiments in which the actuator 20 is a hydraulic cylinder (with a piston rod configured to extend and retract with respect to a barrel), extension of the hydraulic cylinder will cause the pivot shaft 24 to rotate in a first direction and retraction of the hydraulic cylinder will cause the pivot shaft 24 to rotate in a second, opposite direction. The pivot shaft 24 is positioned at the top of the bucket 10 and extends generally laterally to each of the rotation connections 16 that rotatably couple the front section 12 of the bucket 10 with the rear section 14 of the bucket 10.

As such, actuation of the actuator 20 can cause the bucket 10 to shift between the open and closed positions. In more detail, as was described previously, the rotation connections 16 may rotatably connect the upper portions (at the lateral sides) of the front and rear sections 12, 14. The rotation connections 16 may be rigidly connected with the front section 12 and rigidly connected with the pivot shaft 24. In contrast, the rotation connections 16 may be pivotably connected with the rear section 14, such as via one or more bearings (i.e., the rotation connections 16 may each comprise one or more bearings). As such, the rear section 14 is free to rotate with respect to the rotation connections 16. As a result, and with the bucket 10 in the open position, when the actuator 20 is extended, the pivot shaft 24 is caused to rotate in a direction that causes the front section 12 to travel towards the rear section 14 until the bucket 10 is in the closed position (see, e.g., FIGS. 1 and 2). In contrast, with the bucket 10 in the closed position, when the actuator 20 is retracted, the pivot shaft 24 is caused to rotate in a direction that causes the front section 12 to travel away from the rear section 14 until the bucket 10 is in the open position (see, e.g., FIGS. 3 and 4).

In view of the above, the multipurpose bucket 10 of embodiments of the present invention is configured to perform each of the following operations: (1) in a closed position (e.g., FIGS. 1 and 2), the multipurpose bucket 10 can act as a heavy-equipment bucket for picking up (e.g., scooping or digging) and dumping material (e.g., soil/dirt), (2) by selectively actuating between open and closed positions, the multipurpose bucket 10 can act as a grapple for grasping, moving, and dropping material (e.g., logs or debris), (3) in an open position (e.g., FIGS. 3 and 4), the multipurpose bucket 10 can be pushed forward, with a bottom edge of the rear section 14 on or adjacent the ground, to operate as a blade for pushing material (e.g., soil/dirt, snow, etc.), similar to a dozer blade, and (4) in an open position (e.g., FIGS. 3 and 4), the multipurpose bucket 10 can be pulled rearward, with a bottom edge of the front section 12 on or adjacent the ground, to operate as a box blade for back dragging material (e.g., soil/dirt, snow, etc.). In view of the four above-described functions of the bucket 10, the bucket 10 may be referred to as a "4-in-1" bucket. Notably, when operating as a heavy-equipment bucket 10 and holding material, the multipurpose bucket 10 can be opened to dump the material down into a truck bed, raised bin, etc.

Beneficially, because the multipurpose bucket 10 only requires use of a single actuator to open and close the bucket 10, the inventive multipurpose bucket 10 can be manufactured with a smaller size and weight (with respect to prior art multipurpose buckets), such that the multipurpose bucket 10 can be used with smaller heavy-equipment machines (e.g., sub-compact tractors, smaller loaders (e.g., compact utility loaders), etc.).

Figure 7:
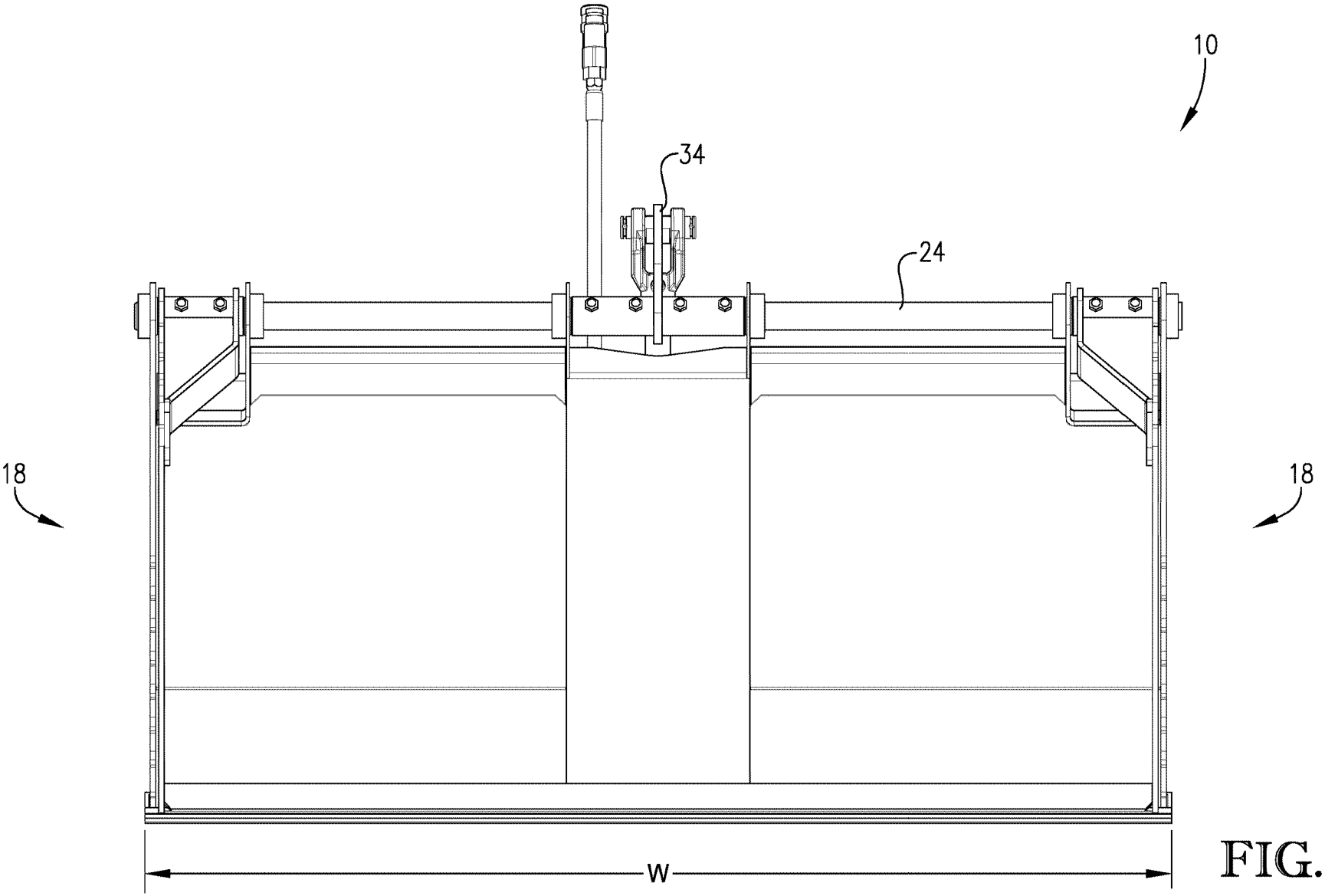
FIG. 7 is a front elevation view of the bucket from FIGS. 1 and 2.
Figure 8:
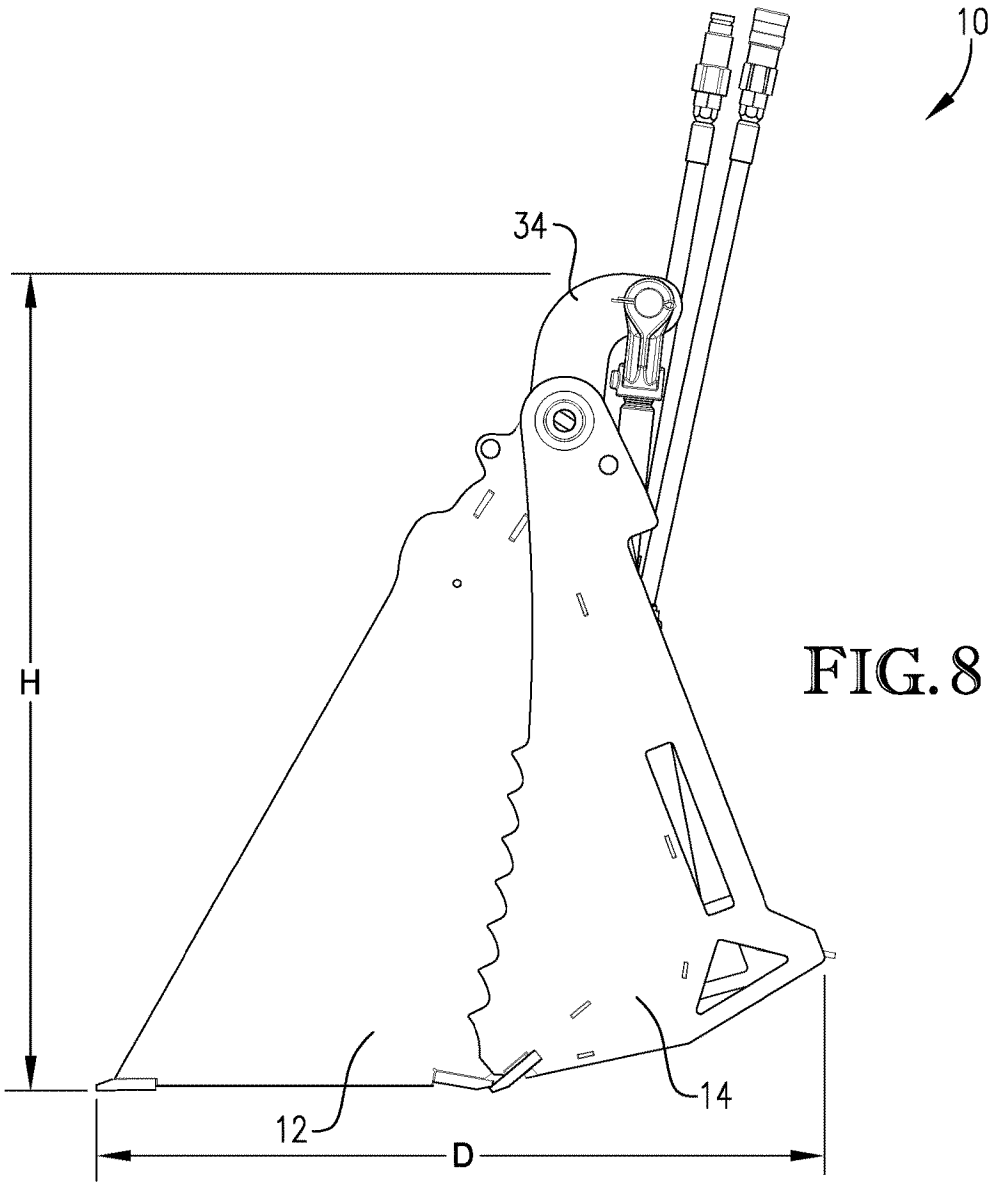
FIG. 8 is a side elevation view of the bucket from FIGS. 1 and 2.
Figure 9:
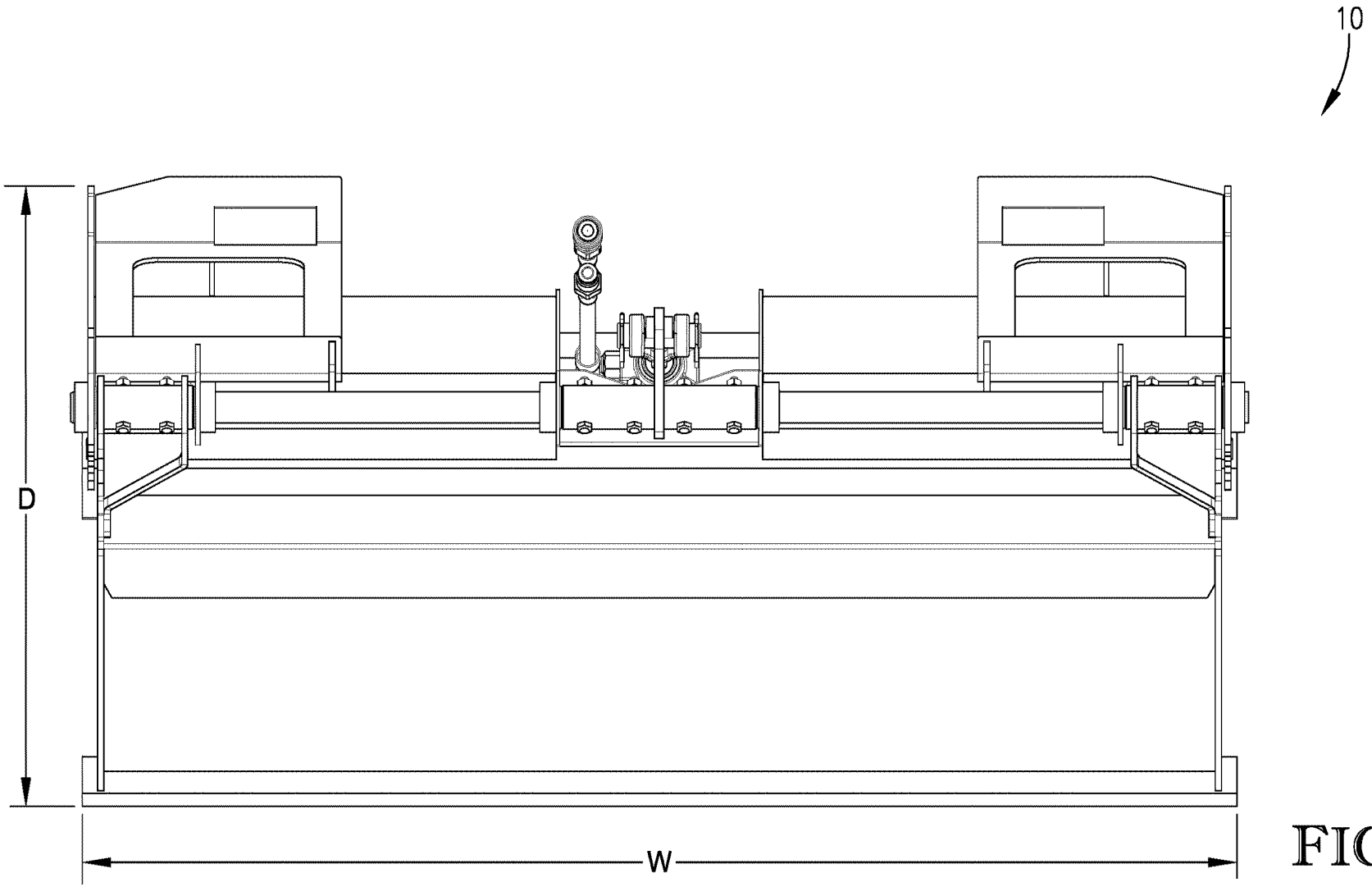
FIG. 9 is a top elevation view of the bucket from FIGS. 1 and 2.

For example, in some embodiments, as illustrated in FIG. 7, the multipurpose bucket 10 may be formed with a width "W" of between 30 and 60 inches, between 40 and 50 inches, or about 46 inches. In some embodiments, as illustrated in FIGS. 8 and 9, the multipurpose bucket 10 may be formed with a depth "D" of between 15 and 35 inches, between 20 and 30 inches, or about 25.5 inches. In some embodiments, as illustrated in FIG. 8, the multipurpose bucket may be formed with a height "H" of between 15 and 35 inches, between 20 and 30 inches, or about 22 inches. In addition, although the multipurpose bucket 10 may be formed from high-strength material, such as steel, the multipurpose bucket 10 may be formed with a weight of between 150 and 350 pounds, between 200 and 300 pounds, between 200 and 225 pounds, between 250 and 300 pounds, no more than 220 pounds, no more than 250 pounds, no more than 280 pounds, no more than 300 pounds, or about 212 pounds, or about 275 pounds. Such reduced weight is generally due to the use of only a single actuator 20.

The relatively smaller heavy-equipment machines that may carry and operate the inventive multipurpose bucket 10 may be defined as machines having a total weight of about or no more than 1,300 pounds, about or no more than 1,500 pounds, about or no more than 1,700 pounds, and/or about or no more than 2,000 pounds. To facilitate use of the bucket 10 by heavy equipment machines, the bucket 10 may include connection elements 40, as illustrated in FIG. 2, on a back side of the bucket 10. Specifically, the connection elements 40 may be located on and/or extend away from a back surface of the rear section 14 of the bucket 10. For instance, the connection elements 40 illustrated in FIG. 2 are positioned adjacent to each lateral side 18 of the bucket 10 and are configured to couple with a quick-hitch mechanism of the smaller heavy-equipment machines. Such quick-hitch mechanism may, for instance, be located at the front of loader arms of a compact utility loader.

Figure 10:
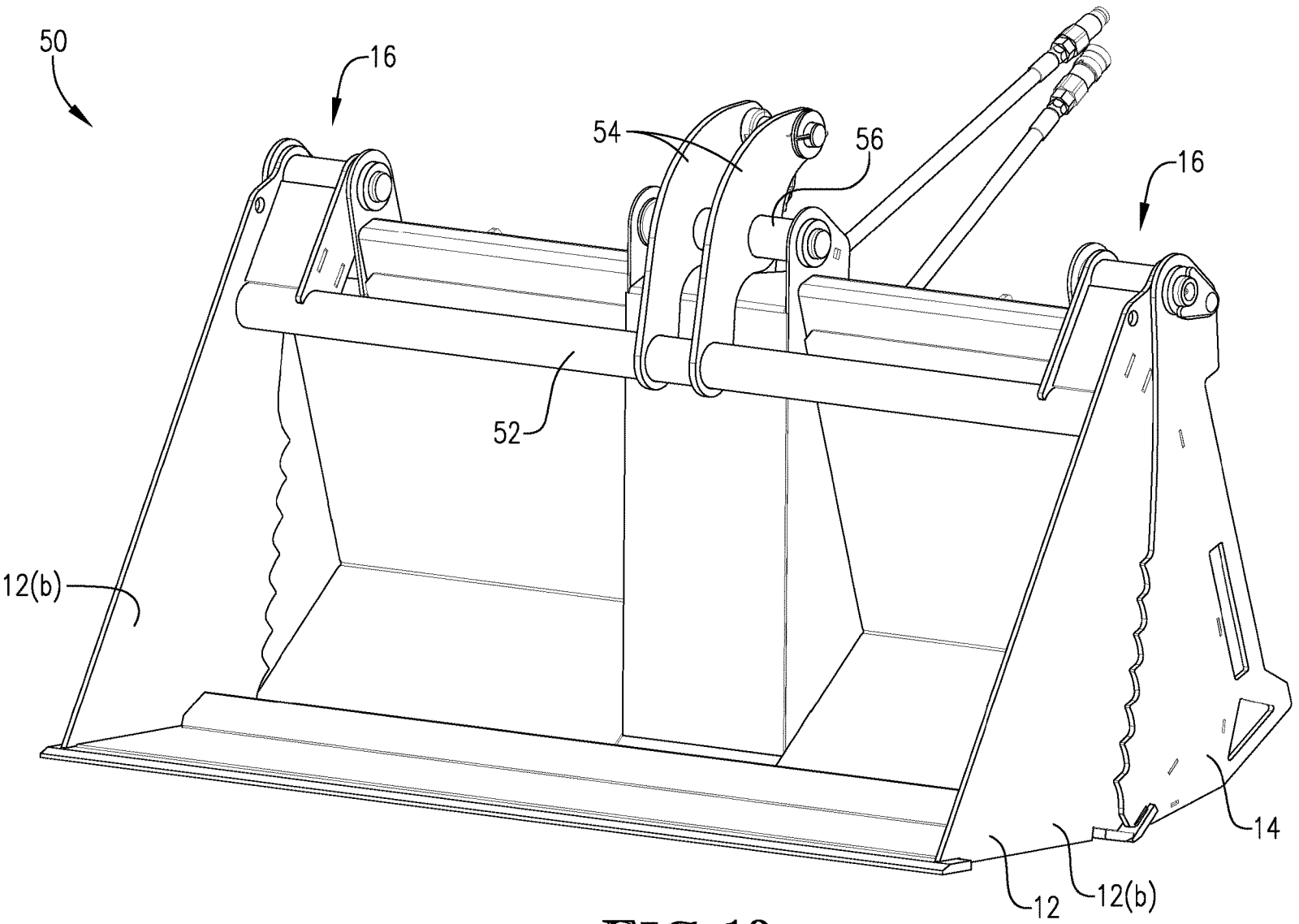
FIG. 10 is a front, side perspective view of a multipurpose bucket according to additional embodiments of the present invention.
Figure 11:
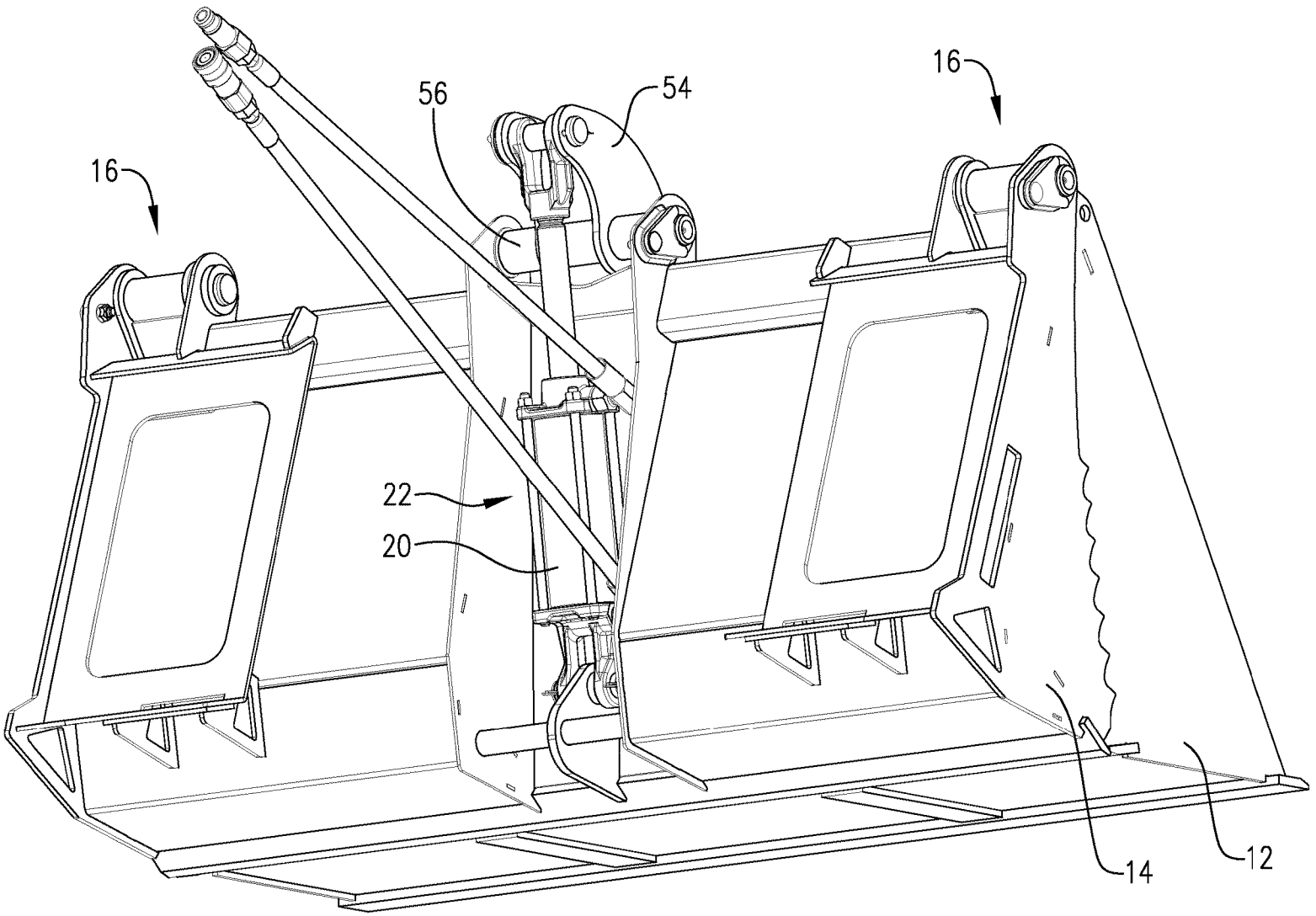
FIG. 11 is a rear, side perspective view of the bucket from FIG. 10.

Although the invention has been described with reference to the one or more embodiments illustrated in the figures, it is understood that equivalents may be employed, and substitutions made herein without departing from the scope of the invention as recited in the claims. For example, as illustrated in FIGS. 10 and 11, another embodiment of a multipurpose bucket 50 is illustrated. The bucket 50 may share many of the same elements and features of the previously-described bucket 10. Contrastingly, however, the bucket 50 may include a rigid shaft 52 in place of a pivot shaft 24. As illustrated, the rigid shaft 52 is positioned forward and below the top of the bucket 50. Specifically, the rigid shaft 52 of bucket 50 is located below a top of the bucket 50 and forward of the rear section 14 of the bucket. Nevertheless, the pivot shaft 24 extends laterally into rigid engagement with the side panels 12(*b*) of the front section 12 and/or with the rotation connections 16 located at either lateral side 18 of the bucket 50. Given such rigid connection, translation of the rigid shaft 52 will facilitate translation of the front section 12 with respect to the rear section 14, so as to cause the bucket 50 to transition between open and closed positions.

To facilitate translation of the rigid shaft 52, the bucket 50 may include a lever arm 54 connecting the actuator 20 and the rigid shaft 52. Such lever arm 54 may be more elongated than the lever arm 34 used in the bucket 10. Specifically, the lever arm 54 may extend from above and behind the front and rear sections 12 14 of the bucket 50 (where the lever arm 54 is rotatingly connected with the top of the actuator 20) downward and forward to a position in front of the rear section 14 where the lever arm 54 engages with the pivot shaft 52. Furthermore, the lever arm 54 may be rotatingly connected to the top of the bucket 50 (e.g., at a top of the rear section 14) via a support bar 56 extending through a central portion of the lever arm 54. Such support bar 56 allows the lever arm 54 to rotate (under force of the actuator 20), so as to cause translation of the rigid shaft 52. Thus, extension/retraction of the actuator 20 causes rotation of the lever arm 54, and correspondingly, rotation of the lever arm 54 causes translation of the rigid shaft 52. As was described previously, translation of the rigid shaft 52 causes the bucket 50 to transition between open and closed positions. Nevertheless, as with other embodiments, it is noted that the bucket 50 includes only a single actuator 20, which may be centrally positioned (e.g., within a pocket 22) with respect to the width of the bucket 50.

Having thus described one or more embodiments of the invention, what is claimed as new and desired to be protected by Letters Patent includes the following:

1. A multipurpose bucket comprising:

a front section;

a rear section rotatably coupled with said front section, such that said bucket is configured to transition from a closed position to an open position, wherein said rear section comprises a main panel that extends between a lower portion and an upper portion of said bucket;

a single actuator configured to transition said bucket between the closed position and the open position, wherein said actuator is centrally positioned with respect to a width of said bucket, wherein said bucket comprises a centrally-positioned pocket formed in said rear section, with said actuator being positioned within said pocket, wherein said pocket extends forward of said main panel, and wherein said pocket opens in a rearward direction to present a cavity at a back side of the bucket in which said actuator is positioned; and a shaft extending along the width of the bucket, wherein actuation of the shaft causes the bucket to transition between the closed and the open positions, wherein the actuator is operably connected with the shaft via a lever arm, wherein a first end of the lever arm is connected to the actuator, wherein a second end of the lever arm is connected to the shaft, and wherein the lever arm is rotatably connected to a top of the bucket at a position between the first and the second end of the lever arm.

2. The multipurpose bucket of claim 1, wherein said lever arm engages with said shaft near a lateral midpoint of said shaft.

3. The multipurpose bucket of claim 1, wherein said bucket comprises a 4-in-1 bucket.

4. The multipurpose bucket of claim 3, wherein said bucket is configured to be selectively shifted between the open and closed positions to function as a grapple.

5. The multipurpose bucket of claim 3, wherein said rear section of said bucket is configured to operate as a dozer blade when said bucket is in the open position.

6. The multipurpose bucket of claim 3, wherein said front section of said bucket is configured to operate as a box blade when said bucket is in the open position.

7. The multipurpose bucket of claim 3, wherein in the closed position said bucket is configured to function as a bucket for picking up and carrying material.

8. The multipurpose bucket of claim 7, wherein said bucket is configured to be shifted to the open position to dump the material picked up and carried.

9. The multipurpose bucket of claim 1, wherein the width of said bucket is of between 30 and 60 inches.

10. The multipurpose bucket of claim 1, wherein a weight of said bucket is no more than 300 pounds.

11. The multipurpose bucket of claim 1, wherein said bucket is configured to be used by a heavy-equipment machine having a weight of no more than 2,000 pounds.

12. A multipurpose bucket comprising:

a front section;

a rear section rotatably coupled with said front section, such that said bucket is configured to transition from a closed position to an open position, wherein said rear section comprises a main panel that extends between a lower portion and an upper portion of said bucket;

a laterally extending shaft extending across at least a portion of a width of said bucket; and a single actuator configured to transition said bucket between the closed position and the open position, wherein said actuator is centrally positioned with respect to the width of said bucket, wherein said actuator is configured to actuate said shaft, and wherein said actuator is engaged with said shaft at or adjacent a lateral midpoint of said shaft, wherein said bucket comprises a centrally-position pocket formed in said rear section, with said actuator being positioned within said pocket, wherein said pocket extends forward of said main panel, and wherein said pocket opens in a rearward direction to present a cavity at a back side of the bucket in which said actuator is positioned, wherein the actuator is operably connected with the shaft via a lever arm, wherein a first end of the lever arm is connected to the actuator, wherein a second end of the lever arm is connected to the shaft, and wherein the lever arm is rotatably connected to a top of the bucket at a position between the first and the second end of the lever arm.

13. The multipurpose bucket of claim 12, wherein a weight of said bucket is no more than 300 pounds.

14. The multipurpose bucket of claim 12, wherein said bucket is configured to be used by a heavy-equipment machine having a weight of no more than 2,000 pounds.

15. A method of operating a multipurpose bucket comprising the following steps:

(a) providing the bucket, which comprises a front section and a rear section rotatably coupled with the front section such that the bucket is configured to transition from a closed position to an open position, wherein the rear section comprises a main panel that extends between a lower portion and an upper portion of the bucket, wherein the bucket additionally comprises a single actuator positioned within a centrally positioned pocket formed in the rear section, wherein the pocket extends forward of the main panel, and wherein the pocket opens in a rearward direction to present a cavity at a back side of the bucket in which the actuator is positioned;

(b) shifting, via the single actuator, the bucket from the closed position to the open position; and (c) shifting, via the single actuator, the bucket from the open position to the closed position, wherein the bucket comprises a shaft extending along the width of the bucket, wherein actuation of the shaft causes the bucket to perform said shifting of steps (b) and (c), wherein the actuator is operably connected with the shaft via a lever arm, wherein a first end of the lever arm is connected to the actuator, wherein a second end of the lever arm is connected to the shaft, and wherein the lever arm is rotatably connected to a top of the bucket at a position between the first and the second end of the lever arm.

16. The method of claim 15, wherein a weight of the bucket is no more than 300 pounds.

* * * * *